United States Patent [19]

Berthelius et al.

[11] Patent Number: 4,797,537

[45] Date of Patent: Jan. 10, 1989

[54] FOIL ELEMENT

[75] Inventors: Rolf Berthelius, Västerås; Tommy Fredriksson, Hallstahammar, both of Sweden

[73] Assignee: Kanthal AB, Hallstahammar, Sweden

[21] Appl. No.: 939,968

[22] Filed: Dec. 10, 1986

[30] Foreign Application Priority Data

Dec. 13, 1985 [SE] Sweden ..... 8505911

[51] Int. Cl.[4] ..... H05B 3/34

[52] U.S. Cl. ..... 219/528; 219/508

[58] Field of Search ..... 219/528, 203, 527, 529, 219/509, 510, 508

[56] References Cited

U.S. PATENT DOCUMENTS

| | | | |
|---|---|---|---|
| 2,834,862 | 5/1968 | Meyers | 219/528 X |
| 3,130,289 | 4/1964 | Katzman et al. | 219/528 X |
| 4,642,887 | 2/1987 | Fredriksson | 29/611 |

FOREIGN PATENT DOCUMENTS

| | | |
|---|---|---|
| 3129862 | 2/1983 | Fed. Rep. of Germany . |
| 375898 | 4/1975 | Sweden . |
| 640094 | 12/1983 | Switzerland . |

*Primary Examiner*—E. A. Goldberg
*Assistant Examiner*—M. M. Lateef
*Attorney, Agent, or Firm*—Burns, Doane, Swecker & Mathis

[57] ABSTRACT

A foil element for the electric heating of objects comprises a resistance heating coil placed between insulating plastic foils and a sensor coil placed between the plastic foils beside the heating coil. The sensor and heating coils are formed of the same metallic material. The sensor coil is spaced sufficiently far from the heating coil to assure that the sensor coil is heated mainly by heat flowing to or from the object being heated and only slightly by heat directly from the heating coil. The electric resistance of the sensor coil is sensed to determine the temperature thereof. The heating coil is controlled in accordance with the temperature of the sensor coil.

5 Claims, 2 Drawing Sheets

FOIL ELEMENT

BACKGROUND OF THE INVENTION

The present invention relates to a so-called foil element for electric heating. By foil element is meant a type of element where the resistance material is placed between insulating plastic foils. The plastic foil can comprise a type of silicone, PVC or polyester, and even combinations of these materials often occur. The electric resistance heating member consisting of metallic material may comprise a meander-shaped coil which can be produced by etching of metal foil. The coils can also be produced by punching according to Swedish Patent Application No. 8404231-6. In use, the foil element is placed against the surface of the object to be heated, such as a water mattress.

For many uses of a foil element a means of controlling the temperature on the heated object within a given interval is required. To be able to do this the temperature of the heated object should be sensed in a suitable way. This could be done either by means of a device separate from the foil element or by a device enclosed in the foil element. In both cases the problem of a correct temperature regulation arises. When using a heat-sensitive control device which is separate from the foil element, i.e., is suitably placed at a distance from the foil element to prevent disturbance from the direct heat transmission therefrom, a problem results from a time delay of heat transfer from the element to the temperature sensing device via the object being heated. The delay is a function, among other things, of the rate and conditions of heat transfer and heat conduction and the effect of the element.

If, on the other hand, the control device is mounted in the foil element a reduced time delay is achieved by the vicinity of the heat source to the sensing device. However, other problems occur because of direct heat transmission from the element to the temperature sensor, whereby the control device is heated substantially only by the resistance coil rather than by the object being heated. In one known arrangement, a sensing coil having a surface area of from about 1 to 5 percent of the total surface area of the heating and sensing coils is positioned so as to be encompassed by the heating coil, i.,e., is within the boundary defined by the heating coil. Thus, the heating of the sensing coil is influenced significantly by a direct heat flow from the heating coil, rather than by the more desirable indirect flow from the object being heated. Also, the sensing coil is formed of a different material and of different thickness than the heating coil and thus is not economical from a production cost standpoint. The cost of a temperature sensor and control equipment can in certain cases be significant in relation to the overall cost of the foil element itself. This is, to no small extent, due to the costs arising in connection with the installation of the temperature sensor in the element.

The aim of this invention is to provide a foil element which incorporates therein a control device by means of which the temperature of the heated object can be measured. A further aim of the invention is to reduce the overall costs of the apparatus for temperature measuring by making this control device a part of the foil element.

BRIEF DESCRIPTION OF THE DRAWING

The invention will, in the following, be illustrated by an example of a preferred embodiment described in connection with the accompanying figures.

DETAILED DESCRIPTION OF A PREFERRED EMBODIMENT OF THE INVENTION

Figure 1:
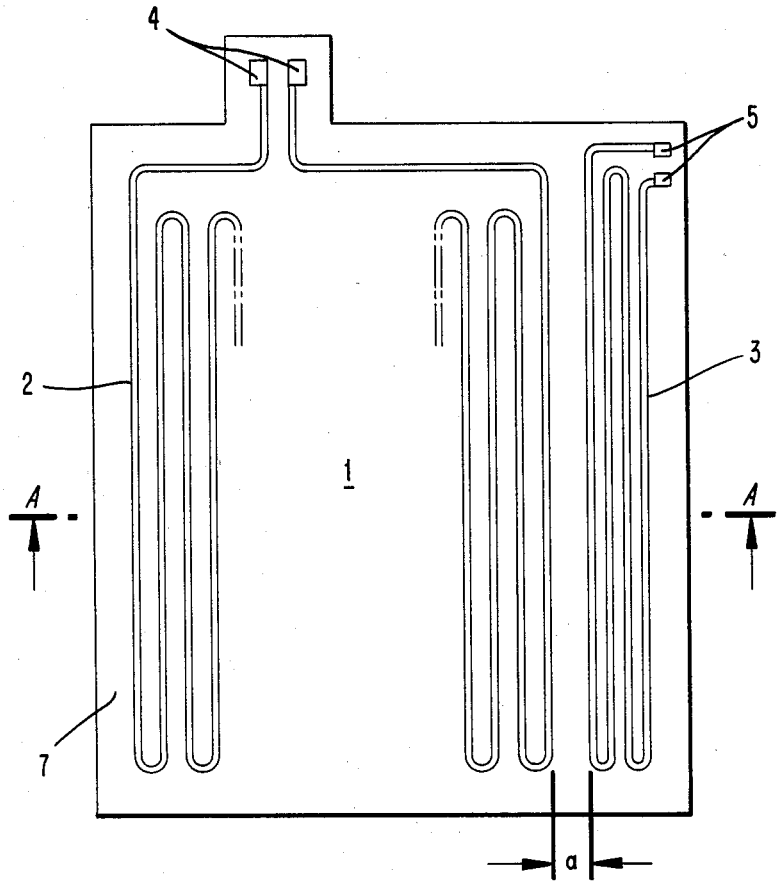
FIG. 1 is a plan view of an element according to the invention with upper foils 6 and 8 removed.

The element shown in FIG. 1 comprises a plastic bearing foil 7 which carries a meander-shaped heating (resistance) coil 2 of metal foil. The coil 2 is produced by etching or punching of metal foil by known methods. The element is equipped with two terminals 4 for connection to an electric voltage source.

Figure 2:
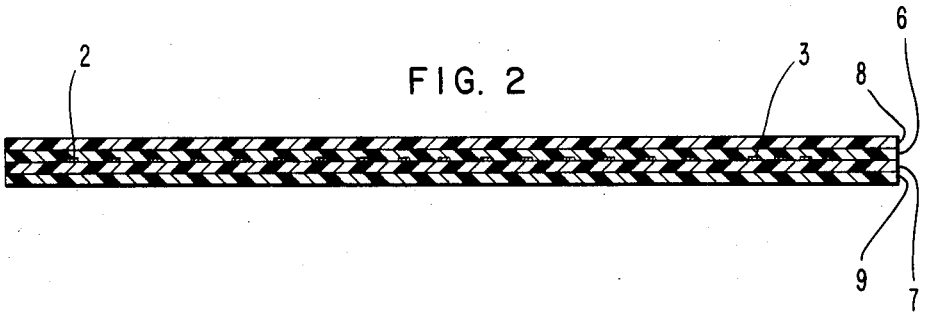
FIG. 2 is a cross-section of the element taken along line A-A in FIG. 1 with foils 6 and 8 included.
Figure 3:
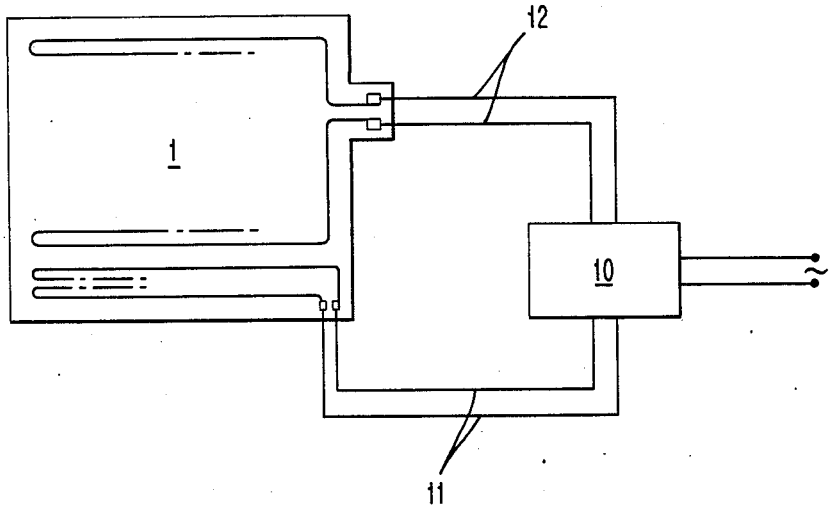
FIG. 3 shows an electric circuit containing an element and a control device.

On the same plastic foil but at a distance a from the heating coil 2 is provided a meander-shaped sensor coil 3. The sensor coil 3 is situated outside the boundary defined by the heating coil 2. The sensor coil 3 is formed of the same metallic sheet material as the heating coil 2 and is produced by a similar operation, e.g., punching or etching whereby the sensing coil has the same thickness as the heating coil (by "thickness" is meant the cross-sectional dimension which is visible in FIG. 2. The sensor coil 3 is equipped with two connections 5 and is used for heating control. The sensor coil is connected via the connection points 5 to a conventional device measuring the resistance of the coil 3. This resistance is temperature dependent whereby the measured temperature thereof can be used to control the temperature of the heating coil. As is apparent from FIG. 2, the heating coil 2 and the sensor coil 3 are embedded between four different plastic foils where, e.g., the foils 6 and 7, situated most closely to the metal coils, comprise polyester foil, and the outer foils 8 and 9 can comprise PVC foils. In FIG. 3 it is shown how a control device 10 is connected on the one hand to a voltage source and on the other, handd to the heating and sensor coils 2, 3 via cables 11, 12, respectively. The device 10 is a simple electronic apparatus which senses the electrical resistance of the sensor coil 3, and hence can determine its temperature since the latter is a function of the resistance. When the sensed temperature attains a preselected value, the heating coil 2 is shut off (or activated).

Elements according to the invention are especially suitable where objects with high thermal inertia are to be heated. An example of such objects is a waterbed where heat is transmitted from the element via the container of the waterbed to the water and is diffused in the water by convection. The water mattress in such a bed can cover a surface of about 3 $m^2$ and has a water depth of about 250 mm. The coil for the heating of the water should have a much smaller surface. By virtue of the invention, it has become possible to obtain a correct control of the temperature to which the water is heated, by means of a relatively small foil element.

An element for the above-mentioned application is 300 mm wide and 950 mm long. The overall width of the heating circuit is 235 mm and that of the sensor circuit about 20 mm. The distance between heating circuit and sensor circuit is 30 mm. Both circuits have a length of 840 mm. The heating and sensing coils are each produced from brass foil of a thickness of 0.025 mm. The power effect of the foil element is about 350 W.

The sensor coil is heated mainly by the heated object and only slightly by heat transfer directly from the resistance coil whereby it has been found possible to more exactly control the temperature of the heated object, i.e., the less the sensor coil is influenced by direct heat from the heating coil, the more easily can the temperature of the heated object be controlled in an accurate manner.

Especially for waterbeds, but probably also for other applications, it can be desirable to divide the object to be heated into several parts. It, therefore, occurs that in waterbeds the water mattress is divided into two parts by means of a longitudinal partition. Both parts are intended to be heated to the same temperature. It would be possible to equip each part with an element and control device operating according to the above description. The two elements would then work somewhat independently and not be turned on or off exactly at the same time. However, this would entail periodically the creation of a voltage difference between the two elements which could lead to a static electricity capable of causing a very uncomfortable feeling for the user of the waterbed. The tests performed to discharge the static electricity in different ways have not given satisfactory results.

Figure 4:
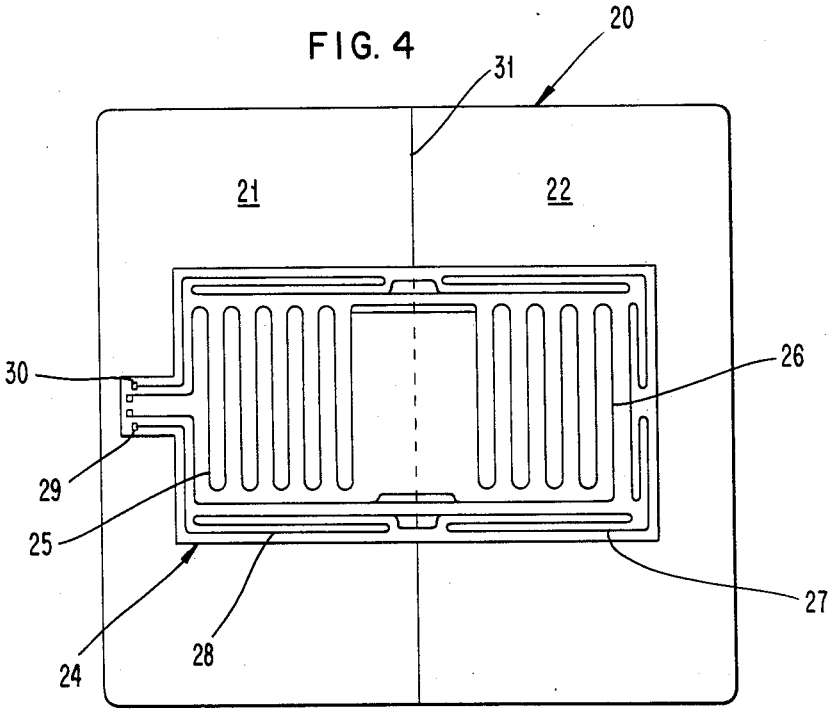
FIG. 4 is a plan view of a modified form of heating element according to the invention, with the upper foils removed, and disposed on a water mattress.

This problem can be solved by a particular arrangement of an element 24 according to the invention shown in FIG. 4. A water mattress 20 divided into two chambers 21 and 22 by a partition 31 is shown in FIG. 4. The element 24 has a heating coil divided into two equal sections 25 and 26 which are interconnected in series. The sections 25, 26 are electrically connected in series to each other. The temperature sensor coil is also divided into two sections 27 and 28. The division of the two coils shall be effected in equal proportions and is achieved in such a way that each of the two sections of the sensor coil is divided into two smaller sub-sections. This is achieved by positioning the sensor coil on both sides of the terminals 29 and 30. However, such a division is without importance. The essential feature rests in the two sections of the heating coil having the same electrical resistance.

The sensor coil of the element shown in FIG. 4 is arranged in a different way than the element shown in FIG. 1. In FIG. 1 the sensor coil is placed to only one side of the resistance coil, whereas in FIG. 4 the sensor coil is placed around three sides of each section 25, 26.

Other locations of the two coils in relation to each other are possible in FIGS. 1 and 4, but it is essential that the distance between resistance and sensor coils is large enough that the sensor coil is affected to only a very small extent by the heat transmitted directly from the heating coil. For example, in the examples described above, the distance between the sensor coil and heating coil shall be a minimum of 20 mm and preferably should be about 40 mm.

The surface areas (visible in FIG. 1) of the sensor coil and the heating coil should be such that the sensor coil represents from 10 to 40 percent of the total surface area of the coils. Within this range a correct relation can be achieved between the heat quantities being conveyed to the sensor coil mainly from the heated object and slightly by heat transfer directly from the resistance coil.

It will be appreciated that by increasing the surface area of the sensor coil in relation to the total surface area of both coils (i.e., by making the surface area of the sensor coil to be from 10 to 40 percent of the total surface area of the coils), the influence on the sensor coil of the direct heat from the heating coil is reduced, whereby a more accurate control of the temperature of the object being heated may be obtained. This advantage is enhanced by locating the sensor coil outside of the boundary defined by the heating coil. Furthermore, by making the sensor and heating coils of the same metallic material and of the same thickness, the manufacturing costs are greatly reduced.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What we claim is:

1. Heating apparatus for heating a planar surface, including an electric resistance foil heating element, said element comprising at least two plastic foils, a metallic electric resistance heating coil disposed between said foils and occupying a substantial portion of the area of the element surface to heat objects placed against the surface of the element, a metallic sensor coil formed of the same metallic material and of the same thickness as said heating coil and situated beside said heating coil between said foils at a distance from said heating coil and in coplanar relationship therewith, said sensor coil occupying a smaller portion of the area of the element surface than said heating coil, said sensor coil being electrically isolated from said heating coil and spaced sufficiently far from said heating coil that said sensor coil is heated primarily by heat conducted through said foils and is heated to a smaller extent by direct heat from said resistance coil, whereby the temperature of said sensor coil is determined substantially by the heat traveling to or from the object being heated.

2. Heating apparatus according to claim 1 including control means connected to said heating coil and said sensor coil for measuring the electrical resistance of said sensor coil and supplying electricity to said heating coil in accordance with the measured resistance of said sensor coil.

3. Heating apparatus according to claim 1, wherein said sensor coil is situated outside the boundary defined by said heating coil.

4. Heating apparatus according to claim 1, wherein said heating coil comprises at least two spaced-apart sections interconnected in series, said sensor coil comprising at least two sections interconnected in series, said sections of said heating coil being situated adjacent respective said sections of said sensor coil.

5. Heating apparatus according to claim 1, wherein said heating and sensor coils each include a surface area, the ratio of said surface area of said sensor coil to the total surface area of said heating and sensor coils being from 10 to 40 percent.

* * * * *